United States Patent [19]

Watanabe et al.

[11] 4,189,130

[45] Feb. 19, 1980

[54] BLAST-FURNACE TUYERE

[75] Inventors: Hideto Watanabe; Shigeo Shoji; Akimune Sato, all of Kurashiki; Takashi Oka, Kyoto, all of Japan

[73] Assignees: Kawasaki Steel Corporation; Toyo Calorizing Ind. Co., Ltd., both of Kobe, Japan

[21] Appl. No.: 952,930

[22] Filed: Oct. 19, 1978

[51] Int. Cl.[2] ..... C21B 7/16

[52] U.S. Cl. ..... 266/270; 428/675; 428/926

[58] Field of Search ..... 266/265, 270

[56] References Cited

U.S. PATENT DOCUMENTS

| | | | |
|---|---|---|---|
| 3,069,760 | 12/1962 | Schultz | 266/265 UX |
| 3,977,660 | 8/1976 | Nakahira | 266/265 |

*Primary Examiner*—M. J. Andrews

*Attorney, Agent, or Firm*—Young & Thompson

[57] ABSTRACT

A blast-furnace tuyere having excellent thermal shock resistance and high durability consists of a tuyere substrate composed of copper or copper alloy, a self-fluxing alloy metallized layer sprayed on the substrate, a cermet coating sprayed on the alloy metallized layer, and a ceramic coating sprayed on the cermet coating. The cermet coating is made from a mixture of an alloy material consisting essentially of 5 to 60 wt% of Co, 5 to 50 wt% of Ni, 5 to 25 wt% of Cr, 5 to 40 wt% of Mo, 5 to 40 wt% of W, 3 to 40 wt% of Si and inevitable impurities, and a ceramic eutectic material consisting essentially of 95 to 65 wt% of $Al_2O_3$, 5 to 30 wt% of $ZrO_2$, 2 to 20 wt% of $TiO_2$, 3 to 30 wt% of $SiO_2$ and inevitable impurities. The ceramic coating is made from the same ceramic material as used in the formation of the cermet coating.

7 Claims, 4 Drawing Figures

BLAST-FURNACE TUYERE

The present invention relates to an improvement of a blast-furnace tuyere, and more particularly it relates to a blast-furnace tuyere provided with a super thermal-shock resistant composite coating.

Figure 1:
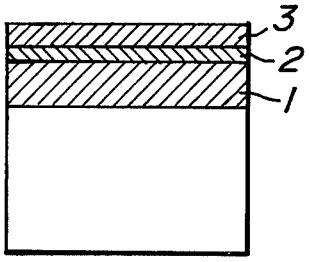
FIG. 1 PRIOR ART

In general, the tuyere is composed of copper or copper alloy as a subtrate and usually used in a water-cooling fashion for blowing hot air into a blast furnace. However, since the end portion of the tuyere projects inside the furnace and is exposed to severe circumstances in the furnace, the life of the tuyere is relatively short due to the exposure to an elevated temperature in the furnace, the wearing caused by contacting with the charge during the descending or disturbed dusts, the dissolving loss caused by contacting the molten iron or slag and the like. Thus, in order to improve the tuyere life, there have hitherto been used blast-furnace tuyeres provided with a composite coating, which are obtained by applying a metal coating 2 to a copper substrate 1 of the tuyere body and further applying a ceramic coating 3 to the metal coating 2 as shown in FIG. 1. In these tuyeres, however, the metal coating 2 is apt to peel off from the copper substrate 1 because the metal coating has a poor bonding property to the copper substrate in view of material of the coating to be used. Furthermore, there is a great difference in thermal expansion coefficient between the metal coating 2 and the ceramic coating 3, so that the ceramic coating 3 peels off from the metal coating 2 at the deposited surface in use at an elevated temperature. Therefore, it has been ascertained that such tuyeres are not suitable for practical use.

Figure 2:
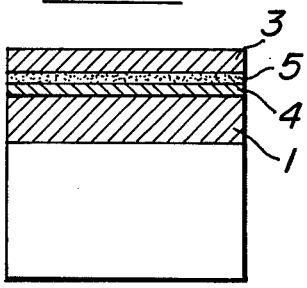
FIG. 2 PRIOR ART

In order to solve the aforementioned drawbacks of the tuyere as shown in FIG. 1, a blast-furnace tuyere having a composite coating as shown in FIG. 2 has already been proposed by the inventors in Japanese Patent Application Publication No. 22, 724/77. The tuyere shown in FIG. 2 is composed of a copper substrate 1, a self-fluxing alloy metallized layer 4 sprayed on the copper substrate 1, a cermet coating 5 sprayed on the alloy metallized layer 4, and a ceramic coating 3 sprayed on the cermet coating 5. In this way, the bonding of the alloy metallized layer to the substrate becomes complete and the peeling off of ceramic coating from the deposited surface is prevented to a certain extent, whereby the prolongation of the tuyere life can be accomplished to a certain extent.

Figure 3:
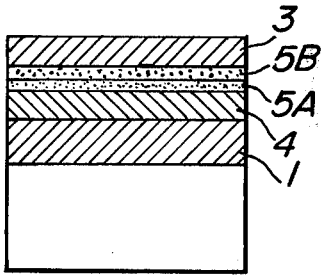
FIG. 3 PRIOR ART

The inventors have made further studies with respect to the improvement of the tuyere shown in FIG. 2 and as a result, a blast-furnace tuyere as shown in FIG. 3 has also been proposed in Japanese Patent No. 839,333. In such a tuyere, the cermet coating is constructed with a lower coating layer 5A and an upper coating layer 5B using a mixture of heat resistant ceramic materials and alloy binder. The lower coating layer 5A is made from the mixture having a low mixing ratio of the heat resistant ceramic material, and the upper coating layer 5B is made from the mixture having a high mixing ratio of the heat resistant ceramic material. Thus, this tuyere makes it possible to further prolong the tuyere life.

The inventors have made various investigations with respect to the composition of materials forming the cermet and ceramic coatings in the blast-furnace tuyere described in the above patent articles and found out that the tuyere life can considerably be prolonged by using materials with a composition as defined below for the cermet and ceramic coatings, respectively.

It is an object of the present invention to provide a blast-furnace tuyere having excellent thermal-shock resistance and high durability as compared with the conventional tuyeres.

The blast-furnace tuyere according to the present invention consists of a tuyere substrate composed of copper or copper alloy, a self-fluxing alloy metallized layer sprayed on the surface of the substrate, a cermet coating sprayed on the surface of the alloy metallized layer and a ceramic coating sprayed on the surface of the cermet coating, and is characterized in that the cermet coating is made from a mixture of an alloy material consisting essentially of 5 to 60 wt% of cobalt, 5 to 50 wt% of nickel, 5 to 25 wt% of chromium, 5 to 40 wt% of molybdenum, 5 to 40 wt% of tungsten, 3 to 40 wt% of silicon and inevitable impurities, and a ceramic material consisting essentially of 95 to 65 wt% of $Al_2O_3$, 5 to 30 wt% of $ZrO_2$, 2 to 20 wt% of $TiO_2$, 3 to 30 wt% of $SiO_2$ and inevitable impurities and having an eutectic structure, and the ceramic coating is made from the same ceramic material as used in the formation of the cermet coating.

The present invention will now be described in greater detail with reference to the accompanying drawings, wherein:

FIGS. 1 to 3 are fragmentary cross-sectional views of conventional tuyeres used for a blast furnace as mentioned above, respectively; and FIG. 4 is a fragmentary cross-sectional view of an embodiment of the tuyere according to the present invention.

Figure 4:
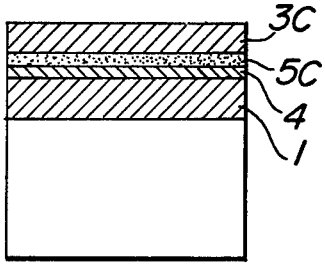

Referring to FIG. 4, the tuyere according to the present invention comprises a tuyere substrate 1 composed of copper or copper alloy. On the surface of the substrate 1 is sprayed a self-fluxing alloy to form a self-fluxing alloy metallized layer 4. The self-fluxing alloy includes, for example, nickel base self-fluxing alloy, nickel-chromium base self-fluxing alloy and cobalt base self-fluxing alloy, each containing given amounts of boron and silicon.

Then, a mixture of alloy material and ceramic material is sprayed on the surface of the alloy metallized layer 4 to form a cermet coating 5C. According to the present invention, the material of the mixture for the formation of the cermet coating 5C has been examined in order to satisfy such a requirement that the cermet coating 5C firmly bonds to the alloy metallized layer 4 on the one hand and a ceramic coating 3C to be formed at subsequent step on the other hand. As a result, it has been found that a mixture of an alloy material consisting essentially of 5 to 60 wt% of Co, 5 to 50 wt% of Ni, 5 to 25 wt% of Cr, 5 to 40 wt% of Mo, 5 to 40 wt% of W, 3 to 40 wt% of Si and inevitable impurities, and a ceramic material consisting essentially of 95 to 65 wt% of $Al_2O_3$, 5 to 30 wt% of $ZrO_2$, 2 to 20 wt% of $TiO_2$, 3 to 30 wt% of $SiO_2$ and inevitable impurities and having an eutectic structure is most suitable for the formation of the cermet coating 5C. The alloy material having the above defined composition is superior in the high-temperature wear resistance to Ni-Cr alloy and Ni-Al alloy and in the resistance against dissolving loss to the Ni-base self-fluxing alloy and Co-base self-fluxing alloy. The ceramic material having the above defined composition has an improved bonding property to the alloy material as compared with $Al_2O_3$ having a purity of more than 90% or $ZrO_2$ having a purity of more than 90%. Moreover, it has been confirmed that a mixture of alloy material excluding the above defined composition and ceramic material excluding the above defined composition does not satisfy the requirements as described above and is not suitable for the formation of the cermet coating 5C.

Next, a ceramic material is sprayed on the surface of the cermet coating 5C to form a ceramic coating 3C as an outermost coating layer. In this case, the ceramic material used for the formation of the ceramic coating 3C must have the same composition as the ceramic material in the mixture used for the formation of the cermet coating 5C. Otherwise, the ceramic material cannot satisfy the above mentioned requirements.

The embodiment of manufacturing the blast-furnace tuyere according to the present invention will be described below with reference to FIG. 4.

(i) The surface of the copper substrate 1 is previously roughned by any mechanical means so as to improve its bonding property and then cleaned.

(ii) A self-fluxing alloy is applied on the surface of the copper substrate 1 to form the alloy metallized layer 4. As the self-fluxing alloy is preferably used a nickel base self-fluxing alloy consisting of 65 to 90 wt% of Ni, 10 to 35 wt% of Cr, 1.5 to 4.5 wt% of Si, 1.5 to 4.5 wt% of B and inevitable impurities or a cobalt base self-fluxing alloy consisting of 40 to 60 wt% of Co, 19 to 21 wt% of Cr, 24 to 28 wt% of Ni, 1.5 to 4.5 wt% of Si, 1.5 to 4.5 wt% of B and inevitable impurities. Such a self-fluxing alloy is sprayed by means of a spraying device using plasma jet or oxy-acetylene flame as a heat source to form the alloy metallized layer 4 having a thickness of 50 to 150 μm.

(iii) On the alloy metallized layer 4 is sprayed a mixture of alloy material and ceramic material to form the cermet coating 5C. The preferred ceramic material consists essentially of 5 to 30 wt% of $ZrO_2$, 65 to 95 wt% of $Al_2O_3$, 2 to 20 wt% of $TiO_2$, 3 to 30 wt% of $SiO_2$ and inevitable impurities and has an eutectic structure. The preferred alloy material acting as a binder consists essentially of 5 to 60 wt% of Co, 5 to 50 wt% of Ni, 5 to 25 wt% of Cr, 5 to 40 wt% of Mo, 5 to 40 wt% of W, 3 to 40 wt% of Si and inevitable impurities. In such a mixture, the mixing ratio of the alloy material to the ceramic material is 3:7 to 7:3. The thickness of the cermet coating 5C is 50 to 250 μm.

(iv) The same ceramic material as used in the formation of the cermet coating 5C is sprayed on the cermet coating 5C to form the ceramic coating 3C having a thickness of 100 to 300 μm. The preferred ceramic material consists essential of 5 to 30 wt% of $ZrO_2$, 70 to 95 wt% of $Al_2O_3$, 2 to 20 wt% of $TiO_2$, 3 to 30 wt% of $SiO_2$ and inevitable impurities and has an eutectic structure.

In this way, a blast-furnace tuyere having improved thermal-shock resistance and high-temperature wear resistance can be obtained.

The following example is given in illustration of the present invention and is not intended as limitations thereof.

EXAMPLE

A thermal shock test was carried out with respect to six specimens sampled from the blast-furnace tuyeres according to the prior art and the present invention to obtain a result relating to the tuyere durability as shown in the following Table 1.

In the thermal shock test, each of the specimens was immersed in molten iron flowing at 1,500° C. in a trough for a blast-furnace every 10 seconds, whereby the immersion number till the dissolving loss was measured. The more the immersion number, the better the tuyere durability.

In table 1, Specimen Nos. 1 to 3 are the tuyeres of the prior art, wherein Specimen No. 1 corresponds to the structure shown in FIG. 1, Specimen No. 2 corresponds to the structure shown in FIG. 2 and Specimen No. 3 corresponds to the structure shown in FIG. 3, while Specimen Nos. 4 to 6 are the tuyeres according to the present invention shown in FIG. 4 wherein the compositions of the materials forming the alloy metallized layer and the cermet coating are shown in detail in the following Tables 2 to 4, respectively and the ceramic coating is made from the same ceramic material as used in the formation of the cermet coating.

Table 1

| | Specimen No. | Substrate (rod of 30mmϕ × 200mm) | Metal layer | Cermet coating First layer | Cermet coating Second layer | Cermet coating Third layer | Ceramic coating | Immersion number |
|---|---|---|---|---|---|---|---|---|
| Prior Art | 1 | Pure copper | 60%Ni—15%Cr—Fe, Mn | | | | $Al_2O_3$ | 1 |
| | 2 | " | Ni base self-fluxing alloy | 50%(Ni—Cr) + 50% $Al_2O_3$ | | | $Al_2O_3$ | 3 |
| | 3 | " | " | 75%(Ni—Cr) + 25% $Al_2O_3$ | 50%(Ni—Cr) + 50% $Al_2O_3$ | 25%(Ni—Cr) + 75% $Al_2O_3$ | $Al_2O_3$ | 5 |
| Present invention | 4 | " | " | 50%(Co—Ni) + 50%($Al_2O_3$—$ZrO_2$) | | | $Al_2O_3$—$ZrO_2$ | 9 |
| | 5 | " | " | 50%(Co—Ni—Mo—W—Si) + 50%($Al_2O_3$—$ZrO_2$) | | | $Al_2O_3$—$ZrO_2$ | 10 |
| | 6 | " | " | 50%(Co—Ni) + 50%($Al_2O_3$—$ZrO_2$—$TiO_2$—$SiO_2$) | | | $Al_2O_3$—$ZrO_2$—$TiO_2$—$SiO_2$ | 10 |

Table 2

| Specimen No. | Composition of Ni base self-fluxing alloy (%) Ni | Cr | Si | B | Others |
|---|---|---|---|---|---|
| 4 | 79.0 | 14 | 3.50 | 2.75 | 0.75 |
| 5 | " | " | " | " | " |
| 6 | " | " | " | " | " |

Table 3

| Specimen No. | Composition of alloy material for cermet coating (%) | | | | | | |
|---|---|---|---|---|---|---|---|
| | Co | Ni | Cr | Mo | W | Si | Others |
| 4 | 55 | 45 | — | — | — | — | — |
| 5 | 43 | 8.5 | 16 | 20 | 7.5 | 4.5 | 0.5 |
| 6 | 55 | 45 | — | — | — | — | — |

Table 4

| Specimen No. | Composition of ceramic material for cermet coating (%) | | | | |
|---|---|---|---|---|---|
| | $Al_2O_3$ | $ZrO_2$ | $TiO_2$ | $SiO_2$ | Others |
| 4 | 75.0 | 25.0 | — | — | — |
| 5 | 95.0 | 5.0 | — | — | — |
| 6 | 70.0 | 10.0 | 4.5 | 15.0 | 0.5 |

As seen from the data of Table 1, the immersion number of Specimen Nos. 4 to 6 is about 10 times higher than that of Specimen No. 1 and 2 to 3 times higher than that of Specimen Nos. 2 and 3. Thus, the durability against the dissolving loss due to thermal shock is considerably improved as compared with the prior art.

Furthermore, it has been confirmed that when the tuyeres of the present invention are practically used in blast-furnace operation, they retain the life of 2 to 3 times longer than that of the prior art without causing the dissolving loss and exhibit improved durability.

According to the present invention, the tuyere consists of a substrate, an Ni or Co base self-fluxing alloy metallized layer sprayed on the substrate, a cermet coating sprayed on the alloy metallized layer using a mixture of alloy material consisting mainly of Ni-Co and ceramic eutectic material consisting mainly of $Al_2O_3$-$ZrO_2$, and a ceramic coating sprayed on the cermet coating using the same ceramic material as described above, so that the high temperature wear resistance and resistance to dissolving loss are considerably improved and the tuyere life can be more prolonged. Therefore, the present invention has a significant merit on an improvement of productivity in blast furnace operation.

What is claimed is:

1. In a blast-furnace tuyere consisting of a tuyere substrate composed of copper or copper alloy, a self-fluxing alloy metallized layer sprayed on the surface of the substrate, a cermet coating sprayed on the surface of the alloy metallized layer, and a ceramic coating sprayed on the surface of the cermet coating, an improvement which comprises making the cermet coating from a mixture of an alloy material consisting essentially of 5 to 60 wt% of cobalt, 5 to 50 wt% of nickel, 5 to 25 wt% of chromium, 5 to 40 wt% of molybdenum, 5 to 40 wt% of tungsten, 3 to 40 wt% of silicon and inevitable impurities, and a ceramic material having an eutectic structure and consisting essentially of 95 to 65 wt% of $Al_2O_3$, 5 to 30 wt% of $ZrO_2$, 2 to 20 wt% of $TiO_2$, 3 to 30 wt% of $SiO_2$ and inevitable impurities and making the ceramic coating from a ceramic material having the same composition as used in the formation of the cermet coating.

2. A blast-furnace tuyere as claimed in claim 1, wherein the alloy material for the cermet coating consists essentially of 5 to 60 wt% of cobalt, 5 to 50 wt% of nickel, 5 to 25 wt% of chromium, 5 to 40 wt% of molybdenum, 5 to 40 wt% of tungsten, 3 to 40 wt% of silicon and inevitable impurities.

3. A blast-furnace tuyere as claimed in claim 1, wherein the ceramic material for the cermet coating consists essentially of 5 to 30 wt% of $ZrO_2$, 65 to 95 wt% of $Al_2O_3$, 2 to 20 wt% of $TiO_2$, 3 to 30 wt% of $SiO_2$ and inevitable impurities.

4. A blast-furnace tuyere as claimed in claim 1, wherein the mixture has a mixing ratio of the alloy material to the ceramic material of 3:7 to 7:3.

5. A blast-furnace tuyere as claimed in claim 1, wherein the cermet coating has a thickness of 50 to 250 μm.

6. A blast-furnace tuyere as claimed in claim 1, wherein the ceramic material for the ceramic coating consists essentially of 5 to 30 wt% of $ZrO_2$, 70 to 95 wt% of $Al_2O_3$, 2 to 20 wt% of $TiO_2$, 3 to 30 wt% of $SiO_2$ and inevitable impurities.

7. A blast-furnace tuyere as claimed in claim 1, wherein the ceramic coating has a thickness of 100 to 300 μm.

* * * * *